United States Patent [19]

Inada et al.

[11] Patent Number: 4,951,041

[45] Date of Patent: Aug. 21, 1990

[54] DRIVING METHOD FOR THIN FILM EL DISPLAY DEVICE AND DRIVING CIRCUIT THEREOF

[75] Inventors: Shuji Inada; Toshihiro Ohba; Hiroshi Kishishita, all of Nara; Hisashi Uede, Wakayama, all of Japan

[73] Assignee: Sharp Kabushiki Kaisha, Osaka, Japan

[21] Appl. No.: 215,772

[22] Filed: Jul. 6, 1988

[30] Foreign Application Priority Data

Jul. 7, 1987 [JP] Japan ..... 62-170611

[51] Int. Cl.[5] ..... G09G 3/20

[52] U.S. Cl. ..... 340/767; 340/793; 340/781

[58] Field of Search ..... 340/781, 825.81, 805, 340/766, 767, 811, 812, 793; 315/169.3, 169.1

[56] References Cited

U.S. PATENT DOCUMENTS 4,087,792 5/1978 Asars ..... 340/781

4,554,539 11/1985 Graves ..... 340/781

4,686,426 8/1987 Fujioka et al. ..... 340/781

*Primary Examiner*—Jeffery A. Brier

[57] ABSTRACT

A driving method is described for thin film EL display devices having an EL layer interposed between scanning side electrodes and data side electrodes which are intersected to each other. The method comprises displaying frames formed by a line sequential drive in which voltage corresponding to display data is applied to the data side electrodes. Concurrently, write pulses which are negative and positive with respect to the data side electrodes are applied to the scanning side electrodes. Further the write pulses which are positive or negative with respect to the data side electrodes are applied to the scanning electrodes. The number of light emitting picture elements of the scanning side electrodes is previously detected from display data and the width of the write pulses, which are at least one of positive or negative is controlled in proportion to the number of the light emitting picture elements. Thus, the brightness of the light emitting picture elements is uniform due to the driving circuit thereof.

10 Claims, 7 Drawing Sheets

DRIVING METHOD FOR THIN FILM EL DISPLAY DEVICE AND DRIVING CIRCUIT THEREOF

BACKGROUND OF THE INVENTION

1. Field of the Invention

This invention relates to a driving method for an AC driven capacitive flat matrix display panel, that is, a thin film EL display device, and driving circuit thereof.

2. Description of the Related Art

Conventionally, the thin film EL display device has been driven by a field reversal drive unit which was equipped with a N-ch MOS driver and a P-ch MOS driver as scanning side electrode drive circuits. The system reverses the polarity for each field (for each line sequential drive of a field).

In the U.S. patent application Ser. No. 737,068, now abandoned in favor of a continuation application, Ser. No. 229,751, now allowed, filed on May 23, 1985 (the counterpart in West Germany is Application No. P3518596.1 filed on MAY 23, 1985), the applicant has proposed a driving unit in which luminous intensity irregularity caused by the polarity inversion of the voltage applied to the panel can be eliminated and flickers in a picture can be minimized by reversing the polarity of write waveforms applied to picture elements of each scanning line.

Furthermore, in the U.S. patent application Ser. No. 894,509, now abandoned in favor of a continuation application, filed on May 19, 1986 (the counterpart in West Germany is Application No. P3619366.6 filed on June 9, 1986), the applicant has proposed a drive circuit in which a burning phenomenon of the EL layer resulting from polarization is avoided, the service life of the display panel can be lengthened, and the power consumption can be reduced. This is achieved by creating pulse voltage waveforms with positive and negative which are applied to the picture elements of the EL display panel is a perfectly symmertrical manner by the use of a push-pull type of driver IC provided on the data side.

However, in these driving methods and driving circuits, assuming that the brightness at the time of lighting of all picture elements in an EL panel having 640 picture elements in a frame is 100, as shown in FIG. 8(*a*), the brightness becomes substantially 110% when 100 picture elements (1/6 picture elements) are lighted. This occurs even though this value is changed in accordance with the capacity of driver ICs used for the EL panel, width of write pulses, write voltage, or the capacity of the EL panel.

In these drives, if strip patterns 32*a* to 32*c*, as shown in FIG. 8(*b*), negatively are displayed on an EL panel 10, the brightness of areas 33*a* to 33*d* in which all bits are lighted becomes lower than that of area 34, 35, and 36 in which the number of bits which are lighted is smaller than the former. More importantly, the difference in the brightness between the area 33*d* and the area 34 becomes significantly great. As a result of this, even in the emitting area (white region shown in this figure), strip patterns 34 to 36 become distinctively visible.

The reason for this is due to the fact that since loads of the lines of the EL panel are different due to the difference in the number of light emitting picture elements in the lines panel, voltage waveforms applied to the lines by EL driving high withstanding ICs are different. In FIG. 8(*c*), reference numeral 41 represents a voltage waveform applied to a line in which there are a relatively larger number of light emitting picture elements, reference numeral 42 represents a voltage waveform applied to a line in which there are a relatively smaller number of light emitting picture elements. Reference numerals 43 and 44 represent current waveforms corresponding to the voltage waveforms 41 and 42 respectively. The inclinations of the waveforms of the voltages 41 and 42 are the same until the voltage reaches Vth at which the panel starts emitting light. However, if the voltage exceeds Vth, the current is made constant due to the characteristics of an EL driving withstanding IC, and the inclination of the voltage waveform is made moderate. This occurs despite the fact that the greater current flows to the line in which there are a larger number of emitting picture elements. Therefore the time taken for the voltage to be applied to the picture elements, from the final voltage $V_W$ to the starting voltage of discharge, becomes tB>tA. Consequently, the brightness difference occurs. Symbol tw represents the period of time over which the voltage is applied.

As described above, since the emitted brightness of the display panels is varied due to the number of the emitting picture elements of a scanning electrode, a problem arises in that the quality of the display deteriorates.

SUMMARY OF THE INVENTION

The present invention relates to a driving method for thin film EL display devices having an EL layer interposed between scanning side electrodes and data side electrodes which are intersected to each other. The method comprises displaying a first frame and a second frame alternatively and repeatedly. The first frame is initially formed by a line sequential drive in which voltage corresponding to display data is applied to the data side electrodes. Concurrently, write pulses, which are negative with respect to the data side electrodes, are applied to odd number lines of the scanning side electrodes. Further write pulses, which are positive with respect to the data side electrodes, are applied to even lines of the same. The second frame is then formed by the line sequential drive in which voltage corresponding to display data is applied to the data side electrodes. Concurrently, write pulses, which are positive with respect to the data side electrodes, are then applied to the odd number lines. Further, write pulses, which are negative with respect to the data side electrodes, are then applied to the even number lines. Finally, when the write pulses, which are positive or negative with respect to the data side electrodes, are applied to the scanning electrodes, the number of light emitting picture elements of the scanning side electrodes, which has been previously detected from the display data, and the width of the write pulses (which are at least one of positive or negative) is broadened in proportion to the number of the light emitting picture elements.

It also concerns a driving system for thin film EL display devices having an EL layer interposed between scanning side electrodes and data side electrodes which are intersected to each other. The system comprises a circuit for displaying a first frame and a second frame alternatively and repeatedly. The first frame is initially formed by a line sequential drive in which voltage corresponding to display data is applied to the data side electrodes. Concurrently, write pulses, which are negative with respect to the data side electrodes, are applied to odd number lines of the scanning side electrodes. Further write pulses, which are positive with respect to the data side electrodes, are applied to even lines of the same. The second frame is then formed by the line sequential drive in which voltage corresponding to display data is applied to the data side electrodes. Concurrently write pulses, which are positive with respect to the data side electrodes, are applied to the odd number lines. Further, write pulses, which are negative with respect to the data side electrodes, are applied to the even number lines. Still further, a first switching circuit applies write pulses which are positive with respect to the data side electrodes to the scanning side electrodes and a second switching circuit applies write pulses which are negative with respect to the data side electrodes to the scanning side electrodes. A detection circuit was used to previously detect the number of light emitting picture elements in the scanning side electrodes from the display data. Finally, a control circuit is used to control at least, either the first or second switching circuits, to broaden the width of the write pulses in proportion to the number of the light emitting picture elements previously detected by the detection circuit.

DESCRIPTION OF THE PREFERRED EMBODIMENTS

An embodiment of the present invention will now be described in detail with reference to the accompanying drawings. The present invention is not limited to this description.

In one example, a double insulation (or three-layered) thin film EL display panel is formed as follows.

Figure 1:
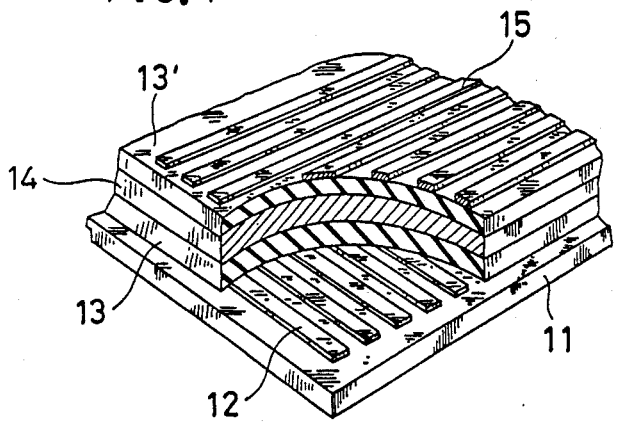
FIG. 1 is a perspective view of a thin film EL display panel according to the present invention.

As shown in FIG. 1, strips of transparent electrodes 12, composed of $In_2O_3$, are put in parallel on a glass substrate 11. Then a dielectric layer 13, composed of $Y_2O_3$, $Si_3N_4$, $TiO_2$ or $Al_2O_3$, and EL layer 14 composed of ZnS doped in activating agent such as Mn, and another dielectric layer 13; composed of $Y_2O_3$, $Si_3N_4$, $TiO_2$, or $Al_2O_3$, each with thickness between 500 and 10,000 Å, are deposited in turn, by a thin film technology such as evaporation or sputtering, on the transparent electrode 12 to form the three-layered construction. Finally, strips of counter electrodes composed of Al are provided in parallel, at right angles to the transparent electrodes 12, on the three-layered construction.

Figure 2:
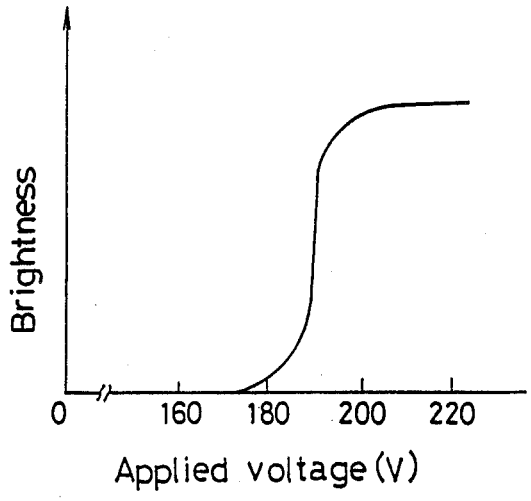
FIG. 2 is a graph showing the brightness characteristics with respect to the applied voltage of the display panel shown in FIG. 1.

The thin film EL panel 10 thus obtained can be considered as a capacitive element from the view of the circuit equivalency because the EL layer 14 is sandwiched in between the dielectric layers 13 and 13' and is interposed between the electrodes. As obvious from the voltage-to-luminance characteristics shown in FIG. 2 the thin film EL is driven by a relatively high level voltage substantially equal to 250 V.

Figure 3:
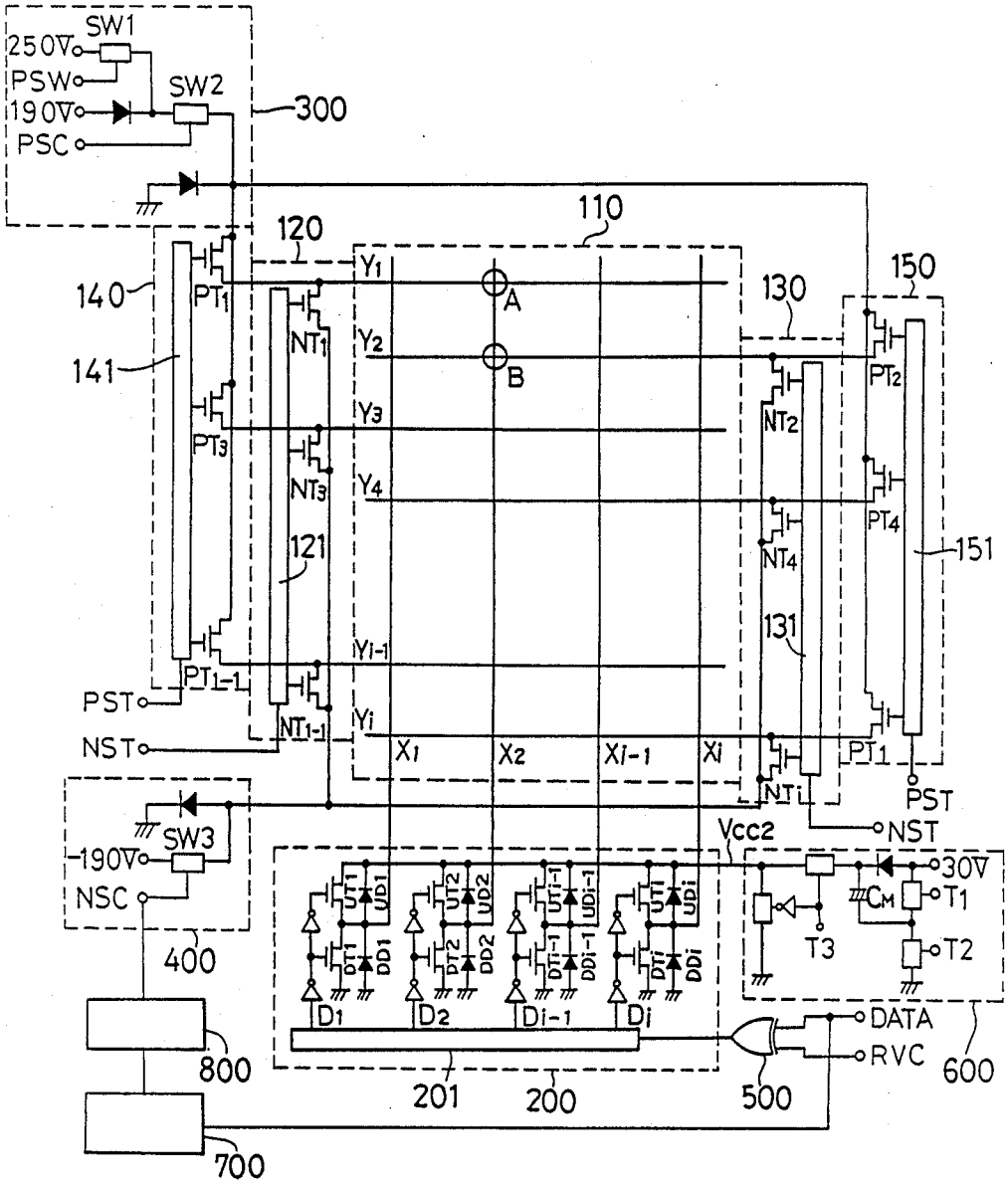
FIG. 3 is an electric circuit to serve as a driving circuit according to one embodiment of the present invention.

FIG. 3 is an electric circuit diagram to serve as a driving circuit for a thin film display device according to an embodiment of the present invention.

Reference numeral 110 represents a thin film EL display device with an emitting threshold voltage of 190 V ($=V_W$) in which data side electrodes are arranged in the X direction and scanning electrodes in the Y direction, and only the electrodes are illustrated. Reference numerals 120 and 130 represent scanning side N-ch high withstanding MOS ICs respectively corresponding to the electrodes of the odd lines and even lines in the Y direction. Reference numerals 121 and 131 represent logic circuits such as shift registers in the MOS ICs 120 and 130. Reference numerals 140 and 150 represent scanning side P-ch high withstanding MOS ICs respectively corresponding to the electrodes of the odd lines and even lines in the Y direction. Reference numerals 141 and 151 represent logic circuits such as shift registers in the MOS ICs 140 and 150 respectively.

Reference numeral 200 represents a data side driver IC corresponding to electrodes in the X-direction. The driver comprises P-ch FET or PNP transistors $UT_1$ to $UT_i$ with a pull-up function of which one side is connected to a power source of voltage $V_M$ (=60 V); N-ch FETs or NPN transistors $DT_1$ to $DT_i$ with a pull-down function of which one side is grounded; and diodes $UD_1$ to $UD_i$ and $DD_1$ to $DD_i$ for passing current in the reverse direction to the corresponding transistors $UT_1$ to $UT_i$ and $DT_1$ to $DT_i$. These components in the driver are controlled by a logic circuit 201, such as shift register provided in the driver IC 200.

Reference numeral 300 represents a source potential selector circuit for the scanning side P-ch high withstanding MOS ICs 140 and 150. Potential 190 V ($=V_W$), 250 V ($=V_W+V_M$) or 0 V is selected by a switch $SW_1$, which is operated by a signal "PSW" and a switch $SW_2$, which is operated by a signal "PSC".

Reference numeral 400 represents a source potential selector circuit for the scanning side N-ch MOS ICs 120 and 130. Potential −190 V ($=-V_W$) or 0 V is selected by a switch $SW_3$ which is operated by a signal "NSC".

Reference numeral 500 is a data reverse control circuit.

Reference numeral 600 represents a circuit for controlling a common line (called $Vcc_2$ hereinafter) for the transistors $DT_1$ to $UT_i$ and diodes $UD_1$ to $UD_i$ provided in the data side driver IC 200. In this circuit 600, a switch T1 is turned off and thereafter a switch T2 is turned on so as to charge a capacitor $C_M$ with a voltage of 30 V ($\frac{1}{2}$ $V_M$). On the other hand, the switch T1 is turned on after the switch T2 is turned off, so as to raise the potential which can be output up to 60 V ($V_M$). A switch T3 acts to switch the common line potential $Vcc_2$ between the potential controlled by the switches T1 and T2 and 0 V.

Reference numeral 700 represents a circuit for previously detecting the number of light emitting picture elements from a signal "DATA".

Reference numeral 800 represents a circuit for making the signal "NSC" high only for a period corresponding to the number of light emitting picture elements.

The operation of the circuit shown in FIG. 3 will now be described with reference to a time chart shown in FIG. 4.

In the description, it is assumed that the scanning electrodes $Y_1$ and $Y_2$, including picture elements A and B respectively, are selected by the line sequential drive. In the driving circuit, the polarity of write voltage applied to picture elements is reversed for every other line. The drive timing for applying a negative write pulse to picture elements in a scanning side selected electrode, by turning on the transistor in the N-ch high withstanding MOS ICs 120 or 130 connected to the scanning side selected electrode, is called a N-ch drive timing. The timing for applying a positive write pulse to the picture element in a scanning side selected electrode, by turning on the transistor in the P-ch high withstanding MOS ICs 140 or 150 connected to the scanning side selected electrode, is called a P-ch drive timing.

A field (frame) in which the N-ch drive is performed for the scanning electrodes of odd lines and the P-ch drive for those of even lines is called a NP field. A field (frame) in which the inverse drive is performed is called a PN field.

Figure 4:
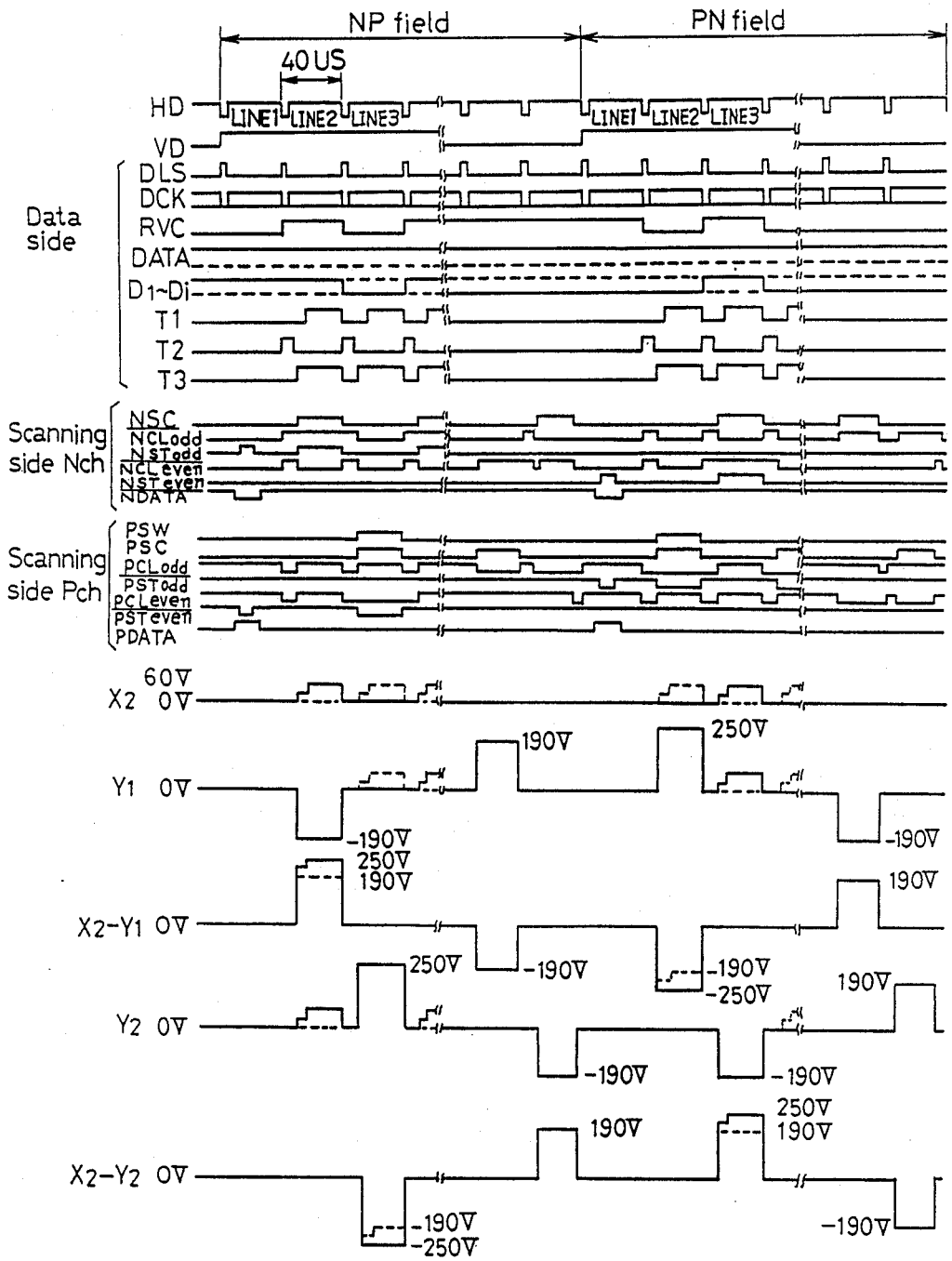
FIG. 4 is a time chart illustrating the operation of the driving circuit shown in FIG. 3.

Referring to FIG. 4, "HD" represents a horizontal synchronization signal and a "high" portion of the signal represents a period in which data is effective. "VD" represents a vertical synchronization signal. A drive for one frame starts at rising edges of this vertical synchronization signal "VD". "DLS" represents a data latch signal which is output every time data for one line has been transmitted. "DCK" represents a data transmitting clock on the data side. "RVC" represents a data reversal signal which is "high" during the data transmitting period of the electrode line for which P-ch drive is conducted. It reverses all the data during the "high" period. "DATA" represents a display data signal. "$D_1$" to "$D_i$" are data input to the transistors $UT_1$ to $UT_i$ and $DT_1$ to $DT_i$ of the data side electrode driver IC 200. For other signals, refer to Table 1 below.

TABLE 1

| Signal | Description |
|---|---|
| NSC | Control signal for the source potential selector circuit (400) for the N-ch high withstanding MOSIC |
| NCLodd | Clear signal for the N-ch high withstanding MOSIC for the odd lines |
| NSTodd | Strobe signal for the N-ch high withstanding MOSIC for the odd lines |
| NCLeven | Clear signal for the P-ch high withstanding MOSIC for the even lines |
| NSTeven | Strobe signal for the P-ch high withstanding MOSIC for the even lines |
| NDATA | Transmission data for the N-ch high withstanding MOSICs |
| PSW,PSC | Control signal for the source potential selector circuit (300) for the P-ch high withstanding MOSICs |
| PCLodd | Clear signal for the P-ch high withstanding MOSIC for the odd lines |
| PSTodd | Strobe signal for the P-ch high withstanding MOSIC for the odd lines |
| PCLeven | Clear signal for the P-ch high withstanding MOSIC for the even lines |
| PSTeven | Strobe signal for the P-ch high withstanding MOSIC for the even lines |

TABLE 1-continued

| Signal | Description |
|---|---|
| PDATA | Transmission data for the P-ch high withstanding MOSICs |

In principle, the data side electrodes are driven by switching the voltage applied to the data side electrode line between 60 V ($=V_M$) and 0 V, at cycles of one horizontal period according to the display data (high : luminous, low : non-luminous).

Figure 5A:
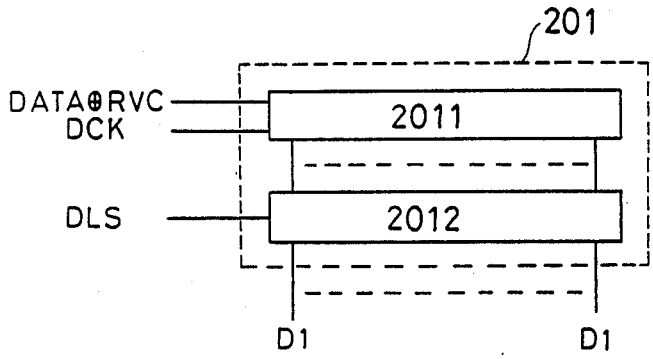
FIGS. 5 (*a*), (*b*) and (*c*) illustrate the logical circuits of the driving circuit shown in FIG. 3.
Figure 5B:
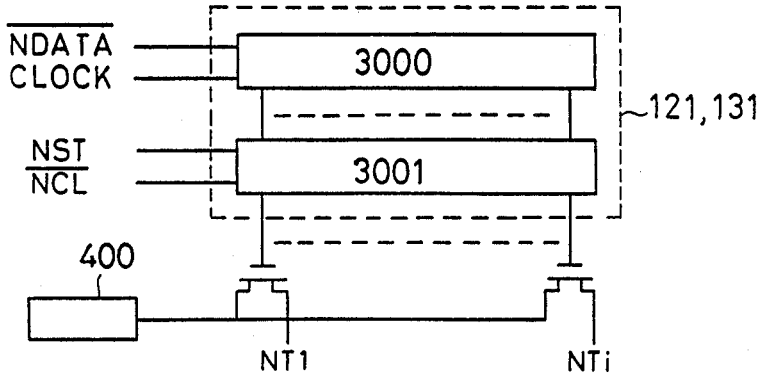
Figure 5C:
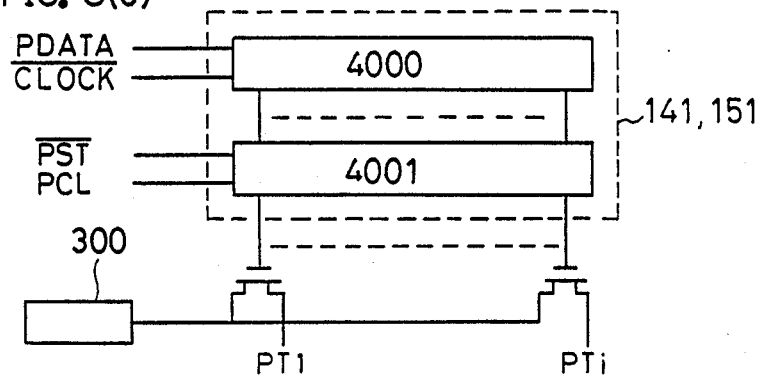

The voltage switch-over timing will now be described. FIG. 5 (*a*) shows the internal construction of the logic circuit 201 of the data side driver IC 200. While a certain data side electrode line is being driven, outputs of an EXCLUSIVE-OR between the display data (high : luminous, low : non-luminous) for the subsequent lines and the signal RVC are sequentially input into the shift register 2011 with memory capacity for one line. Upon completion of data transmission for one line, the EXCLUSIVE-OR inputs "DATA ⊕ RVC", in the shift register are transferred by the signal input DLS into a latch circuit 2012 and stored there until the end of the present drive timing. The transistors $UT_1$ to $UT_i$ and $DT_1$ to $DT_i$ are controlled by the output of the latch circuit 2012. Accordingly, the voltage applied to the data side electrode is switched over at the cycle of one horizontal period for each signal input of "DLS".

With the characteristics of the driving circuit, according to the present invention, even if the transistor UTn is turned on, the above-described voltage of 60 V ($=V_M$) is not immediately applied. Further, the potential is changed from 30 V ($=\frac{1}{2}V_M$) to 60 V ($=V_M$) in a stepped manner due to the $Vcc_2$ control circuit 600 so that the electric power consumption at the time of modulation is reduced to three quarters.

The signal RVC is high during the data transmission period for the line for which P-ch drive is performed. During this period, the signal reverses the data by the following method.

In the P-ch drive, as will be described later, the transistor of the P-ch high withstanding MOS ICs 140 and 150 are turned on to raise the voltage for the selected scanning electrode line to 250 V ($=V_W+V_M$). This reduces the voltage for the selected data side electrodes line to 0 V so that the voltage of 250 V ($=V_W+V_M$) is applied to the picture elements for the luminous emission. Meanwhile the voltage for the electrode lines not selected is maintained at 60 V ($V_M$) so that a voltage of $(V_W+V_M)-V_M=190$ V is applied to the picture elements. Since this voltage level is below the threshold for luminous emission, the picture elements do not emit light. To achieve the above drive, the transistor UTn, connected to a line N of the selected data side electrode, is turned off and the transistor DTn turned on. For the electrode line M which is not selected, the transistor UTm is turned on while the transistor DTm is turned off. In other words, the data input for the selected line, Dn, must be low and data input for the line not selected, Dm, must be high. Since this is inverse to the display data input (high :luminous, low : non-luminous), the signal RVC for inverting data is required. A waveform of voltage applied to the data side electrodes, thus driven, is indicated by $X_2$ in FIG. 4. The solid line shows the waveform when the entire picture elements are emitting, and the broken line shows the waveform when no picture element is emitting.

A drive method for the scanning side electrodes will now be described. The internal construction of the logic circuits 121 and 131 of the N-ch high withstanding MOS ICs 120 and 130 and that of the logic circuits 141 and 151 of the P-ch high withstanding MOS ICs 140 and 150 are shown in FIGS. 5 (*b*) and (*c*), respectively. Reference numerals 3000 and 4000 represent shift registers, and reference numerals 3001 and 4001 represent latch circuits. The truth table values for the respective logic circuits are shown on tables 2 and 3. The constructions of the N-ch high withstanding MOS ICs and P-ch high withstanding MOS ICs are complementary to each other. Although they have reverse logics, they have the identical construction. Therefore, only N-ch high withstanding MOS ICs 120 and 130 will now be described.

TABLE 2

N-ch MOS IC truth value table

| $\overline{NDATA}$ | $\overline{NCL}$ | NST | TRANSISTOR |
|---|---|---|---|
| X | L | X | OFF |
| X | H | L | ON |
| L | H | H | ON |
| H | H | H | OFF |

TABLE 3

P-ch MOS IC truth value table

| PDATA | PCL | $\overline{PST}$ | TRANSISTOR |
|---|---|---|---|
| X | H | X | OFF |
| X | L | H | ON |
| H | L | L | ON |
| L | L | L | OFF |

The shift register 3000 stores a selected scanning side line. It receives the signal $\overline{NDATA}$ during the high period of the CLOCK signal and transfers it during the low period. In this drive circuit, the signals NSTodd and NSTeven are supplied to the N-ch high withstanding MOS IC 120 for odd lines and to the N-ch high withstanding MOS IC 130 for even lines, respectively, as the CLOCK signals, as shown in FIG. 4. The NDATA signal input to the shift register 3000 has only one low portion in a frame which coincides with the first high period of the CLOCK signal "NSTodd" or "NSTeven" input after the rising edge of the signal VD, as shown in FIG. 4. Thus, one CLOCK signal NSTodd or NSTeven is input for every two horizontal periods because N-ch or P-ch drive is alternately conducted for each line. Therefore, the CLOCK signals input into the N-ch high withstanding MOS ICs and into the P-ch high withstanding MOS ICs are staggered in phase by one horizontal period. In the NP field, pulse signals are supplied only for the signal "NSTodd" (=CLOCKodd) to effect N-ch drive for odd lines. In the PN field, they are supplied only for the signal (NSTeven) (=CLOCKeven) to effect N-ch drive for even lines.

The logic circuit 3001 uses two signals "NST" and "NCL" to turn on or off the high withstanding MOS IC transistors and to select one of the three states, according to the data from the shift register 3000, whose logic is based on the truth value table 2.

In P-ch drive, the source potential, for the source potential selecting circuit 300, is made to be 190 V ($=V_W$), and the transistor of the P-ch high withstanding MOS IC 140 is turned on in accordance with data of the logic circuit 141. In N-ch drive, the source potential for the source potential selecting circuit 400 is made to be $-190$ V ($=V_W$), and the transistor of the N-ch high withstanding MOS IC 150 is turned on in accordance with data of the logic circuit 151. Since the data side, during this period, reduces the source voltage of the $Vcc_2$ control circuit 600 to 0 V, the potentials of all of the electrodes $X_1$ to $X_i$ are reduced to 0 V. In the PN field, the inverse drive is conducted.

The above operation will now be summarized. As understood from the above, the operation of the drive circuit of the present invention is roughly divided into two timing blocks: NP field and PN field. When operation for the two fields has been completed, AC pulses required for luminous emission are closed for every picture element of the thin film EL display panel. Each field is further divided into two timing blocks: N-ch drive and P-ch drive. While write pulses are applied, N-ch drive is performed for the scanning side electrode of the selected odd line in the NP field and P-ch drive is performed for the electrode of the selected even line, and vice versa in the PN field.

Next, control of the width of write pulses applied to the scanning side selected lines will now be described.

The width of the write pulses applied to the scanning side selected lines can be changed by controlling the signal "PSW" and/or "NSC" in accordance with the number of the light emitting picture elements. Since the basic constructions of control are the same, the control of the width of the pulses by the signal "NSC" will now be described.

Figure 6:
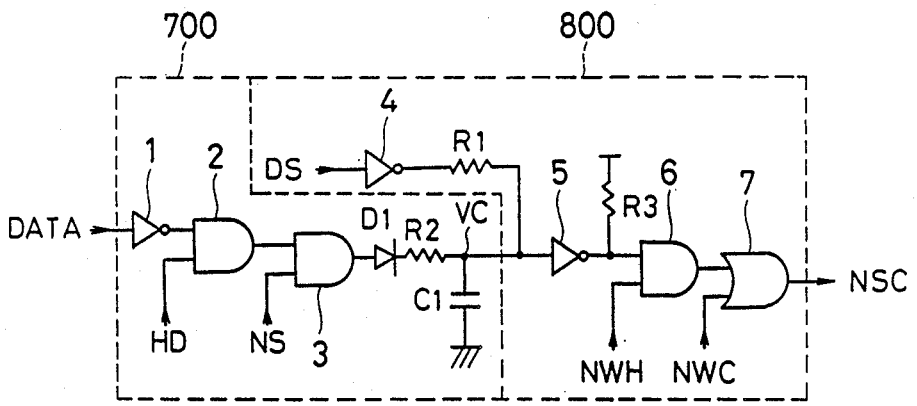
FIGS. 6 (*a*) and (*b*) respectively illustrate, in detail, an essential portion of the driving circuit shown in FIG. 3 and a time chart of the same.
Figure 6:
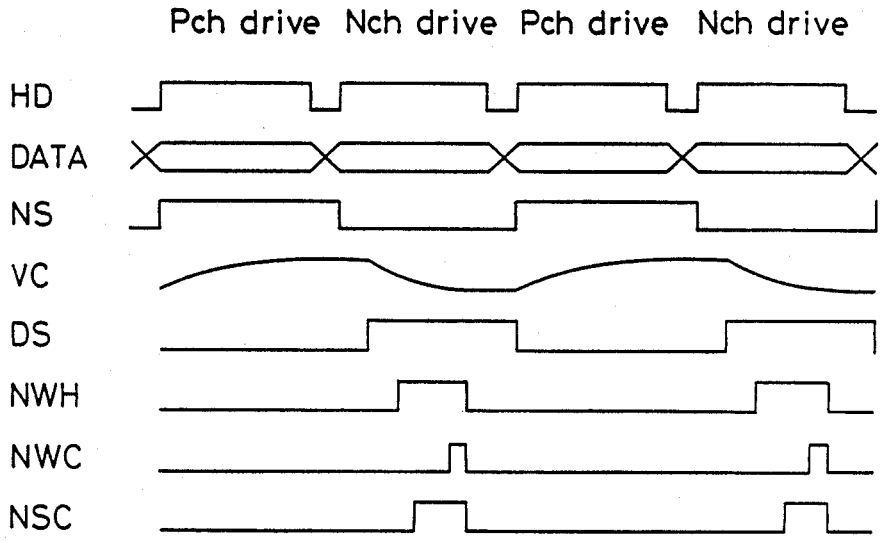

FIG. 6 (*a*) illustrates the circuits 700 and 800 shown in FIG. 3. FIG. 6 (*b*) is a time chart which shows the signal waveforms of the circuits shown in FIG. 6 (*a*). In these figures, reference numerals 1, 4 and 5 represent an inverter (NOT ciucuit), reference numerals 2, 3 and 6 represent AND circuits, and reference numeral 7 represents an OR circuit. First, the signal "DATA" is reversed by the inverter 1, and is input to the AND circuit 2. Since the signal "DATA" is effective, as described above, only when the horizontal synchronization signal "HD" is high, the signal "HD" is also input to the AND circuit 2. Since the signal "DATA" generated from the AND circuit 2 relates to both N-ch and P-ch drives, the logical product of a signal "NS" shown in FIG. 6 (*b*) and the output from the AND circuit 2 is calculated in the AND circuit 3 in order to take out "DATA" related to only N-ch drive. The output "DATA" passes through a diode D1 and a resistance R2, and is charged in a capacitor C1. That is, it is integrated. Since the signal "DATA" has been inverted by the inverter 1, such that the "low" portion is larger in the signal "DATA", the capacitor 1 is charged such that its potential VC rises faster. The diode D1 prevents the charge accumulated in the capacitor Cl from flowing inversely into the AND circuit 3. The resistance R2 is properly set to a value corresponding to the width of the signal "HD". After a certain period of time has elapsed, the charge accumulated in the capacitor C1 is discharged through the resistance R1 when a signal "DS", input to the inverter 4, is high. The discharge per unit period of time is controlled by the resistance R1. Thus, the level, or potential VC of the capacitor C1, becomes as shown in FIG. 6 (*b*).

The output from the inverter 5 becomes a high level and is output in the form of the signal NSC through the AND circuit 6 and the OR circuit 7, only when the potential VC of the capacitor Cl becomes a low level threshold voltage of the inverter 5 after the discharge of the capacitor Cl has been started. If all of the portions of the signal "DATA" input to the inverter 1 are low, the output from the inverter 5 is always high, thereby, causing the signal "NSC" to become high in the period other than N-ch drive. Therefore, a signal "NWH" is prepared in order to secure the maximum pulse width, and the logical product of the output from the inverter 5 and the signal NWH is calculated by the AND circuit 6. Furthermore, in order to prevent the signal "NSC" from being always low due to slight errors of individual parts used in the circuits if all the portions of the signal "DATA" input to the inverter 1 are high, a signal "NWC" is prepared as a minimum pulse width, and the logical sum of it and the output of the inverter 6 is calculated by the OR circuit 7. As described above, the period in which the signal "NSC" is high can be changed between the maximum pulse width signal "NWH" and the minimum pulse width signal "NWC" in accordance with the change of the number of the light emitting picture elements at the time of N-ch drive.

Figure 7:
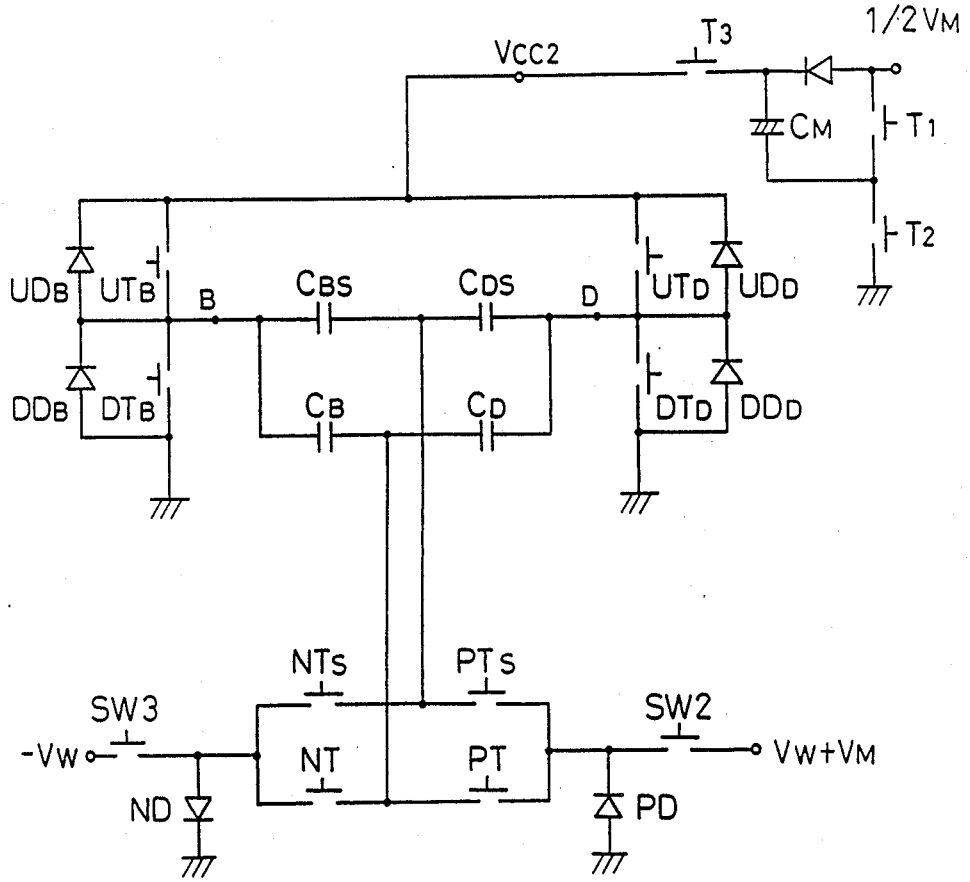
FIG. 7 is an equivalent circuit illustrating the operation of the driving circuit shown in FIG. 3.
Figure 8A:
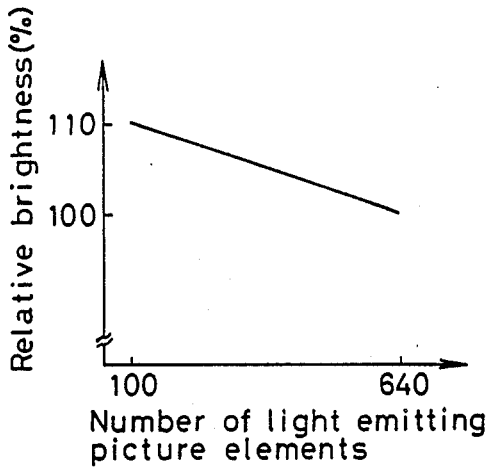
FIG. 8(a) PRIOR ART
FIGS. 8 (*a*), (*b*) and (*c*) respectively show a graph illustrating the relationship between the number of light emitting picture elements and the relative brightness of a conventional display panel, a view illustrating a display pattern, and a view illustrating the relationship between voltage and current waveforms applied to the light emitting picture elements.
Figure 8B:
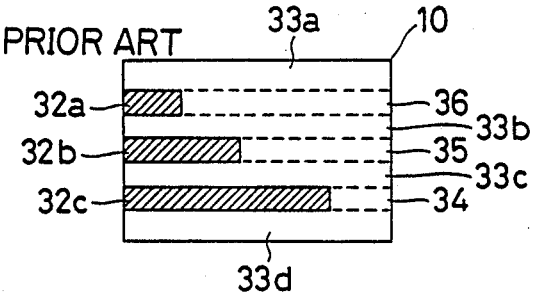
FIG. 8(b) PRIOR ART
Figure 8C:
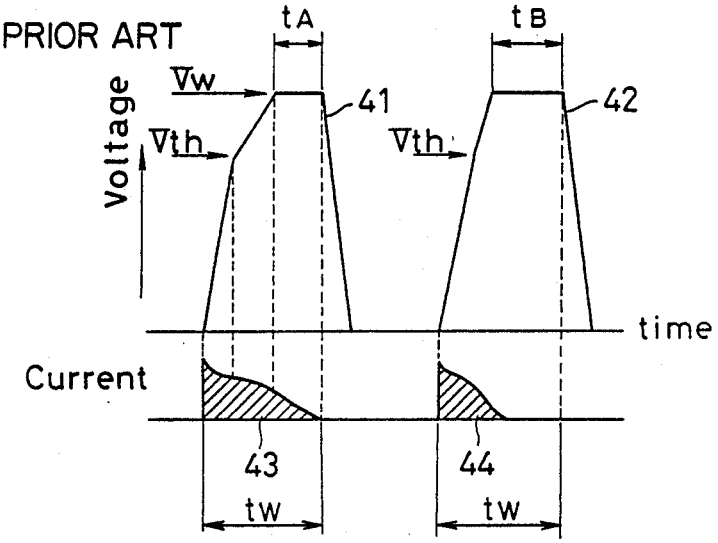
FIG. 8(c) PRIOR ART

The drive according to the present invention will be described with reference to an equivalent circuit shown in FIG. 7. Table 4 illustrates the symbols shown in FIG. 7.

TABLE 4

| Symbol | Description |
|---|---|
| C | Capacitance of a picture element of the EL unit |
| B | The number of picture elements on a scanning side selected line |
| D | The number of the data side electrodes |
| S | The number of the scanning side electrodes |
| $C_{BS}$ | The composed capacitance of data side selected picture elements on the scanning side selected line: B × c |
| $C_B$ | The composed capacitance of the data side selected picture elements on scanning side non-selected lines: (S − 1) × B × C |
| $C_{DS}$ | The composed capacitance of data side non-selected picture elements on the scanning side selected lines: (D − B) × C |
| $C_D$ | The composed capacitance of the data side non-selected picture elements on scanning side selected lines: (S − 1)(D − B) × C |
| $Vcc_2$ | Common line of the data side charging switch circuit |
| $\frac{1}{2} V_M$ | ½ voltage of the modulation voltage |
| T1 | Switch for doubling voltage |
| T2 | Switch for charging the condenser CM |
| T3 | Switch for floating the line $Vcc_2$ |
| $C_M$ | Condenser for charging double voltage |
| $UT_B$ | A general term of the charging transistors connected to the data side selected lines |
| $UT_D$ | A general term of the charging transistors connected to the data side non-selected lines |
| $DT_B$ | A general term of the discharging transistors connected to the data side selected lines |
| $DT_D$ | A general term of the discharging transistors connected to the data side non-selected lines |
| $UD_B$ | $UT_B$ protection diode |
| $UD_D$ | $UT_D$ protection diode |
| $DD_B$ | $DT_B$ protection diode |
| $DD_D$ | $DT_D$ protection diode |
| $NT_S$ | N-ch high withstanding MOS transistors connected to the scanning side selected lines |
| $PT_S$ | P-ch high withstanding MOS transistors connected to the scanning side selected lines |
| NT | N-ch high withstanding MOS transistors connected to the scanning side non-selected lines |
| PT | P-ch high withstanding MOS transistors connected to the scanning side non-selected lines |
| SW3 | Switch for selecting the source of the N-ch MOS transistors between $-V_W$ and 0 V |
| SW2 | Switch for selecting the source of the P-ch MOS transistors between $V_W + V_M$ and 0 V |
| ND | Diodes for usually keeping the source of the N-ch MOS transistors at 0 V |
| PD | Diodes for usually keeping the source of the P-ch MOS transistors at 0 V |

1. Write period of the N-ch drive in NP field

In order to make the source potential of the p-ch high withstanding MOS transistors 0 V, the switch SW2 is turned off. Then one line is selected from the odd number side N-ch high withstanding MOS transistors NTodd in accordance with the data in the logic circuit 121 such that the transistor NTs is turned on. The other N-ch and P-ch high withstanding MOS transistors are turned off without exception. Next, the data side transistors $UT_B$, $UT_D$, $DT_B$, and $DT_D$ continue their drive in the modulation period. The switch T3 is turned on, causing the potential of the line $Vcc_2$ to be changed from 0 V to $\frac{1}{2} V_M$. Then the switch T2 is turned off, while the switch T1 is turned on, such that the potential of the line $Vcc_2$ is raised to $V_M$. As a result, the electrodes including the selected picture elements on the data side, become $V_M$=60 V, and the data side non-selected electrodes become 0 V. Next, in order to make the source potential of the N-ch high withstanding MOS transistors −190 V (=$V_W$), the switch SW3 is turned on by the signal "NSC" whose pulse width is controlled in accordance with the number of the light emitting picture elements. Since the voltage of the scanning side selected electrodes is $-V_W$=−190 V, a voltage of 60 V−(−190 V)=250 V is applied to the picture element $C_{BS}$ between the scanning side selected electrodes and the data side selected electrodes so that light is emitted. Although a voltage of 0 V−(−190 V)=190 V is applied to the picture elements $C_{DS}$ of the data side non-selected electrodes, light is not emitted because the voltage is below the threshold for light emission. The voltage applied to the picture elements $C_B$ and $C_D$ on the scanning side non-selected lines is changed between 0 V and 60 V in proportion to the number of the data side selected lines and non-selected lines since the electrodes on the scanning side are floating.

2. Write period of the P-ch drive in NP field

In order to make the source potential of the N-ch high withstanding MOS transistors 0 V, the switch SW3 is turned off. Then one line is selected from the even number side P-ch high withstanding MOS transistors PTeven, in accordance with the data in the shift register, such that the transistor $PT_S$ is turned on. The other N-ch and P-ch high withstanding MOS transistors $P_T$, $NT_S$, and $N_T$ are turned off without exception. Next, the data side transistors $UT_B$, $UT_D$, $DT_B$, and $DT_D$ continue their drives in the modulation period. The switch T3 is turned on, causing the potential of the line $Vcc_2$ to be changed from 0 V to $\frac{1}{2} V_M$. Then the switch T2 is turned off, while the switch T1 is turned on such that the potential of the line $Vcc_2$ is raised to $V_M$. As a result of this, the data side electrodes including the selected picture elements become $V_M$=60 V and the data side non-selected electrodes become 0 V. In order to make the source potential of the P-ch high withstanding MOS transistors $V_W+V_M$=250 V, the switch SW2 is turned on. Since the scanning side selected electrode is $V_W-V_M$=250 V, a voltage of 250 V−0 V=250 V is, in the form of inversed polarity to the write pulses in the above-N-ch drive, applied to the picture elements between the selected electrodes on the scanning side and the data side, such that light is emitted. Although a voltage of 250 V − 60 V = 190 V is applied to the picture element of the non-selected electrodes on the data side, light is not emitted since the voltage is below the threshold for light emission.

3. Write period of the P-ch drive in PN field

The same drive as P-ch drive in NP field is conducted except that the scanning side selected lines are selected from the odd number lines.

4. Write period of the N-ch drive in PN field

The same drive as NP field is conducted except that the scanning side selected lines are selected from the even number lines and the N-ch high withstanding MOS transistors connected to the lines are turned on. In this case, the pulse width is controlled in accordance with the number of light emitting picture elements as described above.

The pulse width control in the N-ch drive may be applied to the P-ch drive or both of the N-ch and P-ch drives.

The quality of display can be further improved if the kind of drive is determined in which the control of the pulse width is conducted, in accordance with the current which can be passed through the scanning side driver ICs 120, 130, 140 and 150, the capacity of one line in the EL panel, and the length of the drive timing.

According to the present invention, the drive for a thin film EL display panel in which a constant brightness can be obtained regardless of the number of the light emitting picture elements, and an excellent display quality, can be provided.

What is claimed is:

1. A method for driving a matrix display device comprising scan side electrodes interposed in a matrix type format with data side electrodes, comprising the steps of:

(a) repeatedly displaying a first frame, utilizing a line sequential drive, said display of said first frame being formed by,
  (1) applying voltage corresponding to display data to said data side electrodes,
  (2) applying write impulses, which are negative with respect to the voltage applied to said data side electrodes, to odd number lines of said scan side electrodes, and
  (3) applying write pulses, which are positive with respect to the voltage applied to said data side electrodes, to even number lines of said scan side electrodes;

(b) repeatedly displaying a second frame, in an alternate manner with respect to said first frame, utilizing a line sequential drive, said display of said second frame being formed by,
  (1) applying voltage corresponding to display data to said data side electrodes,
  (2) applying write pulses, which are positive with respect to the voltage applied to said data side electrodes, to odd number lines of said scan side electrodes, and
  (3) applying write pulses, which are negative with respect to the voltage applied to said data side electrodes, to even number lines of said scan side electrodes; and (c) controlling the width of said positive and negative write pulses in proportion to the number of light emitting picture elements of each scanning side electrode line which has been previously detected from said display data.

2. A method according to claim 1, wherein the width of write pulses is controlled to be between a maximum width and a minimum width which have been previously determined.

3. A method according to claim 1, wherein the width of write pulses is controlled by adjusting the rise time of the write pulses.

4. A method according to claim 1, wherein the number of light emitting picture elements is detected from non-illuminous signals included in a data signal.

5. A method according to claim 1, wherein the number of light emitting picture elements is detected by integrating pulses corresponding to non-illuminous signals.

6. A driving system for matrix display devices having a layer interposed between scanning side electrodes and data side electrodes which are intersected to each other, comprising:

display means for displaying a first frame and a second frame alternatively and repeatedly;

line sequential drive means for applying voltage corresponding to display data to the data side electrodes, for applying write pulses, which are negative with respect to the data side electrodes, to odd number lines of the scanning side electrodes, and for applying write pulses, which are positive with respect to the data side electrodes, to even lines of the scanning side electrodes, thereby forming said first frame;

said line sequential drive means alternatively, with respect to said first frame, applying voltage corresponding to display data to the data side electrodes, applying write pulses, which are positive with respect to the data side electrodes, to the odd number lines, and applying write pulses, which are negative with respect to the data side electrodes, to the even number lines, thereby forming said second frame alternate to said first frame;

first switching means for applying said write pulses, which are positive with respect to the data side electrodes, to the scanning side electrodes;

second switching means for applying said write pulses, which are negative with respect to the data side electrodes, to the scanning side electrodes;

detection means for previously detecting the number of light emitting picture elements in each scanning side electrode line from the display data; and control means for controlling at least either of said first or second switching means to control the width of the write pulses in proportion to the number of the light emitting picture elements detected by said detection means.

7. A system according to claim 6, wherein the control means comprises a circuit for controlling a maximum and a minimum width of the write pulses.

8. A system according to claim 6, wherein the control means adjusts the width of the write pulses by adjusting the rise time of the write pulses.

9. A system according to claim 6, wherein the detection means detects the number of light emitting picture elements from non-illuminous signals included in a data signal.

10. A system according to claim 9, wherein the control means includes an integrating circuit which integrates pulses corresponding to the non-illuminous signals.

* * * * *